United States Patent [19]

Jackson

[11] Patent Number: 5,016,931

[45] Date of Patent: May 21, 1991

[54] LATCHING MECHANISM HAVING A PRE-ADJUSTED LOAD

[75] Inventor: Frank T. Jackson, Corona, Calif.

[73] Assignee: The Hartwell Corporation, Placentia, Calif.

[21] Appl. No.: 369,026

[22] Filed: Jun. 20, 1989

[51] Int. Cl.[5] ..... E05C 21/02

[52] U.S. Cl. ..... 292/341.18; 411/7

[58] Field of Search ..... 292/142, 341.18, DIG. 60, 292/240, 241; 411/6, 7

[56] References Cited

U.S. PATENT DOCUMENTS

| | | | |
|---|---|---|---|
| Re. 31,935 | 1/1980 | Poe | 292/113 |
| 901,511 | 10/1908 | Winn | 292/57 X |
| 2,373,812 | 4/1945 | Coop | 411/6 |
| 2,894,777 | 7/1969 | Hogan | 292/113 |
| 2,904,141 | 9/1959 | Henrichs | 189/35 |
| 3,273,443 | 9/1966 | Rubin | 411/7 |
| 3,569,910 | 7/1969 | Poe | 339/91 |
| 4,155,575 | 5/1979 | Poe | 292/190 |
| 4,158,463 | 6/1979 | Henrichs | 292/341.18 |
| 4,220,364 | 9/1980 | Poe | 292/341.18 |
| 4,320,912 | 3/1982 | Grace et al. | 292/341.18 |
| 4,478,446 | 10/1984 | Duran | 292/341.18 |
| 4,609,314 | 9/1986 | Metz | 411/7 |
| 4,691,952 | 9/1987 | Harmon | 292/341.18 |
| 4,852,923 | 8/1989 | Harmon et al. | 292/341.18 |

OTHER PUBLICATIONS

Hartwell Brochure for 3-Way Adjusta-Keepers TM for Tension Latches (1978).

Mayr Brochure for Torque Limiting EAS ® Clutches.

*Primary Examiner*—Richard E. Moore

*Attorney, Agent, or Firm*—Lyon & Lyon

[57] ABSTRACT

A mechanism for adjusting the load applied through the keeper or latch portion of a latch assembly. The mechanism includes a main body, a drive system for applying a preload, a slip clutch mechanism for disengaging the drive system when a predetermined preload is reached, and an adjusting means on the slip clutch mechanism for selecting the predetermined preload.

19 Claims, 2 Drawing Sheets

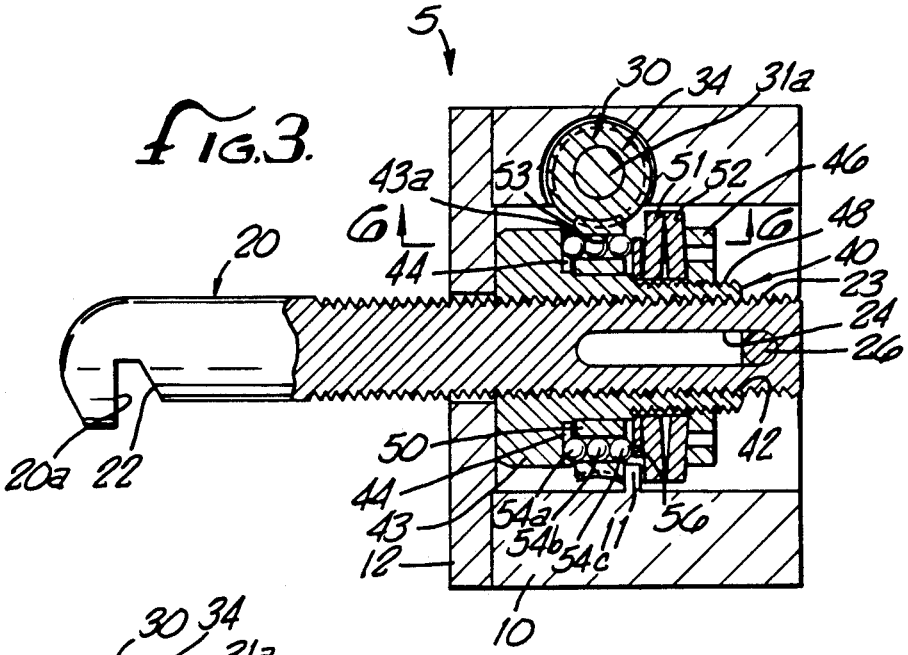
FIG. 3.
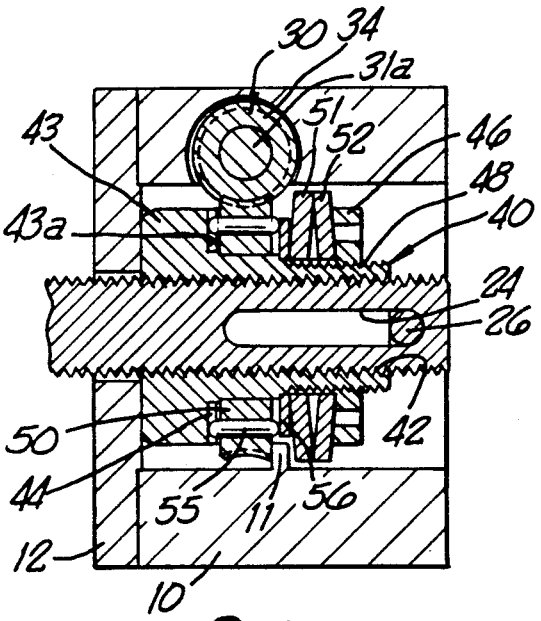
FIG. 3A.
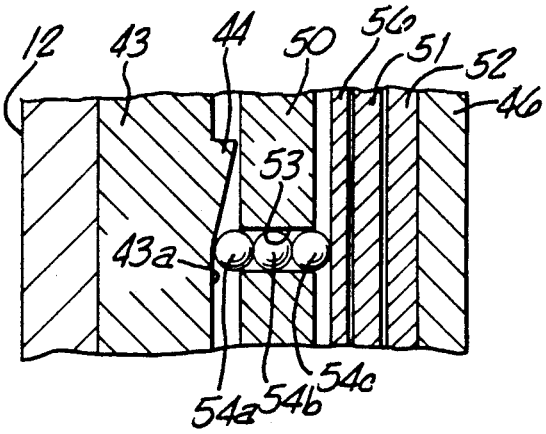
FIG. 6.
FIG. 5.
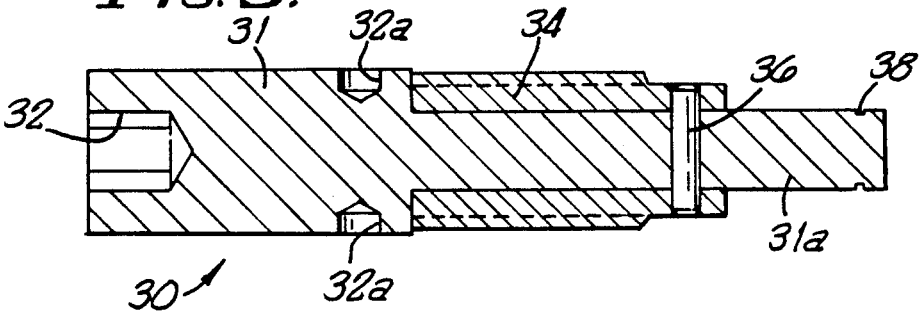

LATCHING MECHANISM HAVING A PRE-ADJUSTED LOAD

BACKGROUND OF THE INVENTION

The field of the present invention is securing devices and more particularly latching assemblies capable of applying a preload suitable for holding down a panel such as an aircraft engine cowling.

Adjustable latches and keepers are known in the field of latch assemblies. In Harmon, U.S. Pat. No. 4,691,952, an adjustable keeper is described which includes a mechanism by which a tension latch assembly may be adjusted and then secured in the adjusted condition. The Harmon adjustable keeper includes a clutch arrangement which prevents the drive system (by which the operator applies a preload) from applying any further preload when a predetermined preload is achieved. The clutch arrangement of the Harmon adjustable keeper selects its predetermined preload by the design of its springs and the size and/or geometry of its clutch ramp surfaces.

SUMMARY OF THE INVENTION

The present invention is directed to providing a latching mechanism capable of applying a preload through a latch. In a preferred embodiment, the latching mechanism includes (1) a slip clutch means for preventing applying any further preload when a predetermined preload has been achieved and (2) a means for adjusting the predetermined preload to be applied through the keeper or hook portion of a latch assembly. The preferred latching mechanism may include a main body, an externally accessible gear drive system for applying the preload, a slip clutch mechanism for disengaging the drive system when the predetermined preload is reached, and an adjusting means on the slip clutch mechanism for selecting the predetermined preload.

BRIEF DESCRIPTION OF THE DRAWINGS

FIG. 3 is a cross-sectional view of FIG. 2 taken along the line 3—3 illustrating details of a slip clutch mechanism;

FIG. 3A is a cross-sectional view of an alternative design for a slip clutch mechanism;

FIG. 5 is a longitudinal cross-sectional view of the drive shaft of FIG. 3; and FIG. 6 is a cross-sectional view of FIG. 3 taken along the line 6—6.

DETAILED DESCRIPTION OF PREFERRED EMBODIMENTS

The preferred embodiments will now be described with reference to the drawings. To facilitate description, any numeral representing an element in one figure will represent the same element in any other figure.

Figure 1:
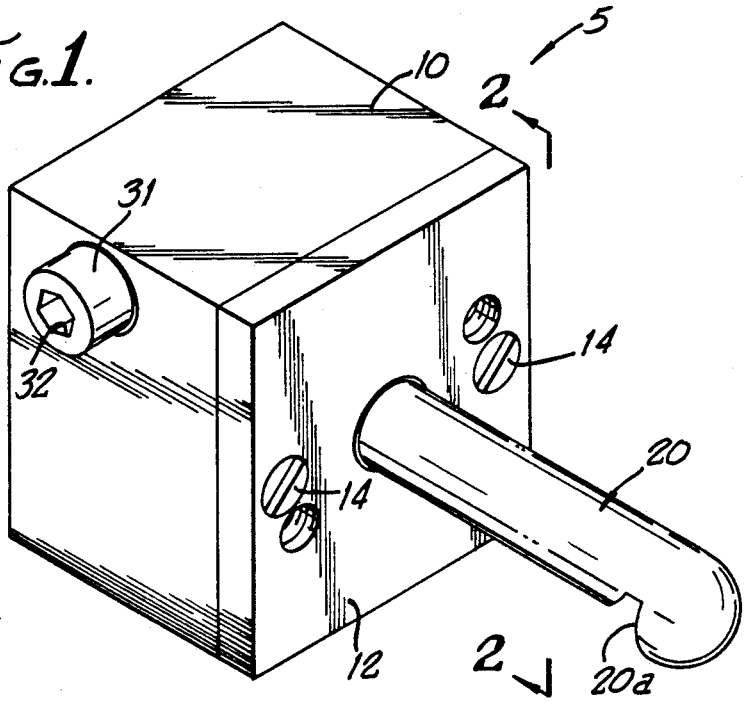
FIG. 1 is a perspective view of a latch mechanism according to the present invention.
Figure 2:
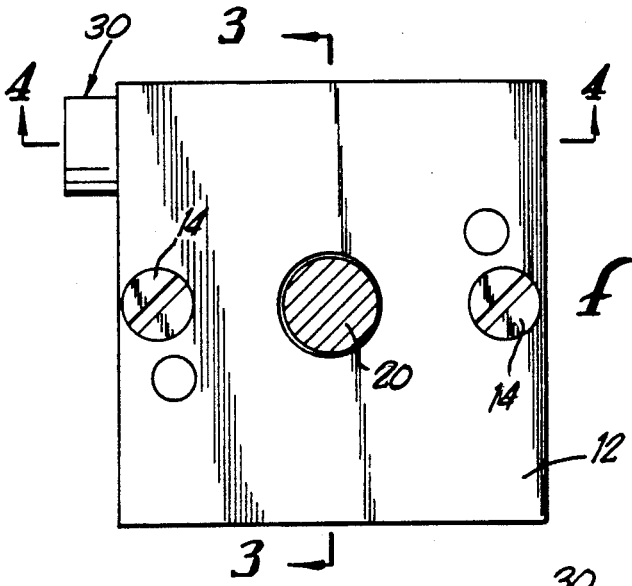
FIG. 2 is a cross-sectional view of FIG. 1 taken along the line 2—2.

FIG. 1 and FIG. 2 illustrate a latching mechanism 5 according to the preferred embodiment of the present invention, including a main body, housing 10 having a front faceplate 12 attached thereto by screws 14, 14. An extension or latch portion 20, having a hook portion **20*a*, extends out from the main body portion 10 through the faceplate 12 for engaging a keeper (not shown). The position of the latch portion 20 is axially adjustable by rotation of the adjusting shaft 31. Once the hook portion 20*a* is latched in place, the adjusting shaft 31 may be rotated by inserting a hex key (not shown) into the adjusting shaft 31. Gearing operated by rotation of the adjusting shaft 31 axially translates the latch portion 20** thereby setting the preload.

Though the extension or latch portion 20 is illustrated having a hook portion **20*a*, the latch portion 20 may alternately be comprised of a keeper (not shown) in place of the hook portion 20*a***. Such a keeper is described in Harmon, U.S. Pat. No. 4,691,952, incorporated herein by reference. One skilled in the art could readily apply the present invention to an adjustable keeper.

To help clarify description, relative directions are arbitrarily defined such that the hook portion **20*a* is forward or to the front and the housing 10** is located to the back or rear.

Figure 4:
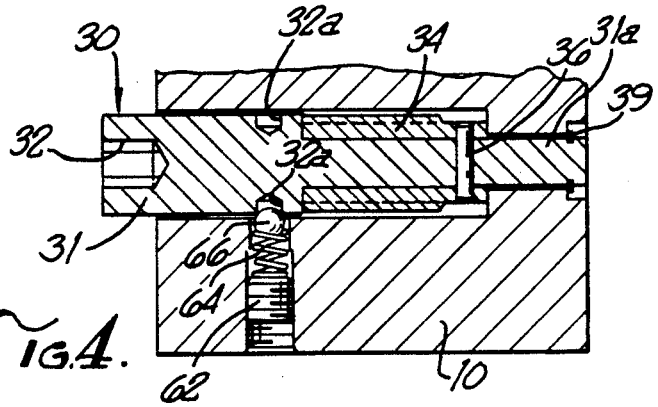
FIG. 4 is a cross-sectional view of FIG. 2 taken along the line 4—4.

FIGS. 3, 4 and 5 illustrates details of the latching mechanism 5. The latch portion 20 is mounted perpendicular to the adjusting shaft assembly 30. Referring particularly to FIGs. 4 and 5, the adjusting shaft assembly 30 is comprised of the adjusting shaft 31 having a drive gear 34 on the back end or narrow neck portion **31*a*. The drive gear 34 is rotatably secured to the neck end 31*a* by a locking pin 36. The adjusting shaft 31 includes a hexagonal hole 32 for accepting a hexagonal key as previously described. The back end 31*a* of the adjusting shaft 31 includes a circumferential groove 38 into which fits a locking ring 39 to secure the adjusting shaft 31 in place within the housing 10**.

Again referring to FIG. 3, the latch portion 20 is typically a circular rod having latch end **20*a* and a threaded end 23. The main drive nut 40 threadably engages the threaded end 23 securing the latch portion 20 in the housing 10. The rotation of the main drive nut 40 axially translates the position of the latch portion 20. The main drive nut 40 includes a shoulder 43 on which a plurality of lands or ramps 44 are positioned on a face 43*a* of the shoulder 43 facing the threaded portion 48 of the main drive nut 40**.

The latch portion 20 axially translates upon rotation of the main drive nut 40 as the latch portion 20 is prevented from rotating having a longitudinal notch 24 in its threaded end 23. A roll pin 26, secured to the housing 10, passes through the longitudinal notch 24 to prevent rotation of the latch portion 20.

The latch mechanism 5 also includes a slip clutch means so that the preload can be preset. As such, the driven gear 50 is positioned concentrically about the main drive nut 50 and rotates freely thereabout. The driven gear 50 has a plurality of channels 53 extending axially therethrough at a given radial distance. A contacting means shown as a plurality of ball bearings **54*a*, 54*b* and 54*c* is placed within each channel 53 and held in position by a backing plate or washer 56. Therefore as the driven gear 50 is rotated, the front ball bearing 54*a* comes in contact with a land 44 on the shoulder 43 of the main drive gear 40 engaging the main drive gear 40 rotating the main drive gear 40 and thereby axially translating the latch portion 20**.

Referring to FIGS. 3 and 6, the backing plate 56 is held in place against the rearmost ball bearing **54*c* by an adjusting nut 46 which is threadably engaged to external threads 48 on the end of the main drive nut 40. Belleville washers 51 and 52 are interposed between the adjusting nut 46 and the backing plate 56 biasing the backing plate 56 against the bearing 54c which in turn presses the front ball bearing 54a against the shoulder 43 of the main drive nut 40**.

The slip clutch mechanism operates as follows. As the adjusting shaft 31 along with the drive gear 34 is rotated by the technician, the drive gear 34 engages and correspondingly rotates the driven gear 50. As the driven gear 50 rotates, the ball bearing 54a engages a land 44, rotating the main drive nut 40 along with the driven gear 50 axially translating the latch portion 20. As the latching force increases, the ball bearing 54a will attempt to ride up the land 44 compressing the Belleville washers 51 and 52. When a predetermined latching force is reached (i.e., the desired preload) the ball bearing 54a rides up and over the land 44 preventing further tightening of the main drive nut 40.

The predetermined preload is set by the tightness of the adjusting nut 46 compressing the Belleville washers 51 and 52. As such, the preload can be preset during manufacturing by the following process. A desired load is applied to the latch portion 20 and the adjusting nut 46 is tightened compressing the Belleville washers 51 and 52 until the ball bearing 54a slips, i.e., rides up and over the land 44 when attempting to turn the adjusting shaft 31 further. The technician can hear and feel when the desired preload on the latch portion 20 has been attained by clicking action resulting from the ball bearing 54a riding up and over the land 44.

Heretofore, adjustable keepers such as that of Harmon, U.S Pat. No. 4,691,952, provided no such adjustability. Predetermined preload was selected by the design of its springs and the size and/or geometry of its clutch ramp surfaces. In order to change or select the predetermined preload, the Harmon device must be dismantled and components replaced. The mechanism 5 according to the present invention can have its predetermined preload adjusted as describe above simply by adjusting the compression of the Belleville washers 51, 52 through the tightening or loosening of the adjusting nut 46. Replacement or modification of components is not required for different predetermined preloads. Therefore, a standard mechanism can be manufactured so that individual units, being adjustable, may be adjusted to desired predetermined preloads.

FIG. 3a illustrates an alternative embodiment for the slip clutch mechanism of FIG. 3 replacing the ball bearings 54a–c (the contacting means) with a dowel or solid pin 55 in the channel 53 within the driven gear 50. The ball bearings 54a–c having the advantage of independently rotating within the channel 5 in contrast to the dowel pin 55 which must slide along the face of the shoulder 43 and the backing plate 56. The ball bearing design of FIG. 3 would therefore likely experience less wear than the pin design of FIG. 3a. Other suitable contacting means may be substituted which would perform the desired function.

Unloading of the latch portion 20 is accomplished by rotating the adjusting shaft assembly 30 in the opposite direction which will rotate the drive gear 34 and the driven gear 50, thereby engaging the ball bearing 54a on the opposite side of the land 44. The slipping force in the unloading direction can be different from the tightening direction. FIG. 6 shows the land 44 having an angle of about 15° in the tightening direction, but in the unloading direction, the land 44 preferably has a steeper angle (illustrated as 90°). A greater load need be applied on the ball bearings 54a–c for the ball bearing 54a to slip over the land 44 in the loosening direction. Both the height and the steepness of the lands 44 may be selected to provide the desired range of forces to allow slipping. The steeper the angle and the greater the height of the land 44, the greater the force required for the ball bearing 54a to ride up and over the land 44.

In addition to the preset preload, the latch mechanism 5 also allows for a clean and smooth outer surface which is desirable particularly in aircraft applications. The latching portion 20 can be positioned completely inside the outer skin of the aircraft fuselage or engine, for example, internally latching the engine cowling. The only protruding portion is the adjusting shaft 31 which can be mounted flush with or beneath the aircraft skin, the latch being loosened or tightened through use of the appropriate tool.

The latching mechanism 5 can be operated with only a 5/16" diameter opening in the aircraft cowling and in many cases without any opening as the adjusting shaft 31 may be placed under a hook latch handle. The adjusting shaft 31 may be produced in any length above the keeper or latch (such as latch portion 20) to allow mounting of the latch mechanism 5 at a desired depth below the aircraft's outer surface.

Thus a mechanism for releasably latching a first body to a second body has been disclosed. Though particular embodiments and advantages have been shown and described, further modifications and advantages may be obvious to one skilled in the art given the descriptions herein. The invention therefore is not to be limited except in the spirit of the law according to claims that follow.

I claim:

1. A mechanism for releasably latching a first body to a second body, comprising (1) a latch housing connectable to the first body;

(2) a latch portion comprising (a) a latch end including a means for engaging the second body, and (b) a threaded stud end; and (3) a drive mechanism for axially translating said latch portion, including (a) a main drive nut rotatably mounted in said housing and threadably connected onto said threaded stud end wherein rotation of said main drive nut axially translates said latch portion;

(b) a drive shaft rotatably mounted in said housing, (c) a drive gear portion connected to said drive shaft, (d) a driven gear operably engaging said drive gear, and (e) means for rotatably engaging said main drive nut with said driven gear including a slip clutch means.

2. The mechanism of claim 1 wherein said main drive nut has an externally threaded first end and a second end with a shoulder, said shoulder having at least one land thereon facing said first end and wherein said slip clutch means comprises (a) an adjusting nut threadably engaging said first end of said main drive nut, (b) at least one contacting means for engaging said land on said shoulder to rotatably engage said main drive nut with said driven gear, said contacting means passing through a channel in said driven gear, (c) biasing means between said adjusting nut and said contacting means for urging said contacting means against said shoulder wherein the tightening or loosening of said adjusting nut compresses or looses said biasing means against said contacting means and into said shoulder of said main drive nut, wherein said contacting means slides over said land at a given latching force determined by tightness selected for said adjusting nut.

3. The mechanism of claim 2 wherein said contacting means is selected from the group consisting of a rod, a pin, and a plurality of ball bearings.

4. The mechanism of claim 2 wherein said biasing means comprises at least one Belleville washer.

5. The mechanism of claim 1 wherein said main drive nut has front end and rear end, the rear end having a shoulder with at least one land thereon facing said rear end and wherein said slipping means comprises (a) at least one contacting means for engaging said land on said shoulder to rotatably engage said main drive nut with said driven gear, said contacting means passing through a channel in said driven gear and (b) biasing means for urging said contacting means against said shoulder, wherein said contacting means slides over said land at a predetermined latching force determined by the force applied by said biasing means.

6. The mechanism of claim 5 wherein said biasing means comprises at least one Belleville washer.

7. The mechanism of claim 5 wherein said contacting means is comprised of a plurality of ball bearings arranged end to end in said channel, the ball bearing nearest the front end contacting said shoulder and the ball bearing nearest the rear end being urged forward by said biasing means.

8. The mechanism of claim 1 wherein said drive shaft has a longitudinal axis perpendicular to the longitudinal axis of said latch portion.

9. A mechanism for adjusting preload to be applied through a latch portion of a latch assembly, the mechanism comprising (a) a drive system including a drive shaft for applying the preload by axially translating the latch portion, (b) a slip clutch mechanism operably connected in said drive system for disengaging said drive system when a predetermined preload is reached, and (c) an adjusting means on said slip clutch mechanism for selecting the predetermined preload, wherein said drive shaft is disposed such that a plane perpendicular to its longitudinal axis is perpendicular to a plane perpendicular to a longitudinal axis of said latch portion.

10. A mechanism for adjusting preload to be applied through a latch portion of a latch assembly, the mechanism comprising (a) a drive system for applying the preload by axially translating the latch portion, (b) a slip clutch mechanism operably connected in said drive system for disengaging said drive system when a predetermined preload is reached, and (c) an adjusting means on said slip clutch mechanism for selecting the predetermined preload, wherein said drive system comprises (a) a main drive nut threadably connected to said latch portion, (b) a worm gear operably connected to said main drive nut through said slip clutch mechanism and (c) a drive shaft having a drive gear, said drive gear engaging said worm gear.

11. A mechanism for adjusting preload to be applied through a latch portion of a latch assembly, the mechanism comprising (a) a drive system for applying the preload by axially translating the latch portion, (b) a slip clutch mechanism operably connected in said drive system for disengaging said drive system when a predetermined preload is reached, and (c) an adjusting means on said slip clutch mechanism for selecting the predetermined preload, wherein said drive system comprises: a main drive nut threadably connected to said latch portion, said main drive nut having an externally threaded first end and a second end with a shoulder, said shoulder having at least one land thereon facing said first end and wherein said slip clutch mechanism comprises (a) an adjusting nut threadably engaging said first end of said main drive nut, (b) at least one contacting means for engaging said land on said shoulder to rotatably engage said main drive nut with said driven gear, said contacting means passing through a channel in said driven gear, and (c) biasing means between said adjusting nut and said contacting means for urging said contacting means against said shoulder wherein the tightening or loosening of said adjusting nut compresses or looses said biasing means against said contacting means and into said shoulder of said main drive nut, wherein said contacting means slides over said land at a given latching force determined by tightness selected for said adjusting nut.

12. The mechanism of claim 11 wherein said biasing means comprises at least one Belleville washer.

13. The mechanism of claim 11 wherein said contacting means is comprised of a plurality of ball bearings arranged end to end in said channel, the ball bearing nearest the front end contacting said shoulder and the ball bearing nearest the rear end being urged forward by said biasing means.

14. A mechanism for adjusting a predetermined preload to by applied by a latch portion of a latch assembly, the mechanism comprising: a housing, a translating means disposed in said housing for axially moving the latch portion and applying a preload, a drive means for actuating the translating means, a slip clutch mechanism disposed between said drive means and said translating means for disengaging the drive means from the translating means when a predetermined preload is reached, and an adjusting means on the slip clutch mechanism for selecting the predetermined preload.

15. The mechanism of claim 14 wherein said translating means comprises a main drive nut threadably connected to said latch portion.

16. The mechanism of claim 14 wherein said drive means comprises (a) a worm gear operably connected to said main drive nut through said slip clutch mechanism and (b) a drive shaft having a drive gear, said drive gear engaging said worm gear.

17. The mechanism of claim 14 wherein said drive shaft is disposed perpendicularly to an axis of said latch portion.

18. The mechanism of claim 14 wherein said drive means comprises: a main drive nut threadably connected to said latch portion, said main drive nut having an externally threaded first end and a second end with a shoulder, said shoulder having at least one land thereon facing said first end and wherein said slip clutch mechanism comprises (a) an adjusting nut threadably engaging said first end of said main drive nut, (b) at least one contacting means for engaging said land on said shoulder to rotatably engage said main drive nut with said driven gear, said contacting means passing through a channel in said driven gear, and (c) biasing means between said adjusting nut and said contacting means for urging said contacting means against said shoulder wherein the tightening or loosening of said adjusting nut compresses or looses said biasing means against said contacting means and into said shoulder of said main drive nut, wherein said contacting means slides over said land at a given latching force determined by tightness selected for said adjusting nut.

19. The mechanism of claim 18 wherein said land has a given angle of inclination over which said contacting means must slide in order to slip when said latch is tightened, said angle of inclination selected to achieve a desired range for selected preload.

* * * * *

UNITED STATES PATENT AND TRADEMARK OFFICE

CERTIFICATE OF CORRECTION

PATENT NO. : 5,016,931

DATED : May 21, 1991

INVENTOR(S) : Frank T. Jackson

It is certified that error appears in the above-identified patent and that said Letters Patent is hereby corrected as shown below:

In claim 14 (column 6, line 44), delete "by applied by" and insert therefor -- be applied to --.

Signed and Sealed this

Twenty-third Day of February, 1993

*Attest:*

STEPHEN G. KUNIN

*Attesting Officer*

*Acting Commissioner of Patents and Trademarks*